US006068102A

United States Patent [19]

Kawase

[11] Patent Number: 6,068,102

[45] Date of Patent: May 30, 2000

[54] COIN IDENTIFICATION DEVICE FOR IDENTIFYING A COIN ON THE BASIS OF CHANGE IN MAGNETIC FIELD DUE TO EDDY CURRENTS PRODUCED IN THE COIN

[75] Inventor: Masahiro Kawase, Higashimatsuyama, Japan

[73] Assignee: Canon Denshi Kabushiki Kaisha, Saitama-ken, Japan

[21] Appl. No.: 08/974,697

[22] Filed: Nov. 20, 1997

[30] Foreign Application Priority Data

Nov. 27, 1996 [JP] Japan ..... 8-315746

[51] Int. Cl.[7] ..... G07D 5/08

[52] U.S. Cl. ..... 194/317

[58] Field of Search ..... 194/317, 318

[56] References Cited

U.S. PATENT DOCUMENTS 4,601,380 7/1986 Dean et al. ..... 194/318

5,609,234 3/1997 Walker et al. ..... 194/317

5,764,055 6/1998 Kawase ..... 324/249

*Primary Examiner*—Robert P. Olszewski

*Assistant Examiner*—Bryan Jaketic

*Attorney, Agent, or Firm*—Robin, Blecker & Daley

[57] ABSTRACT

A coin identification device for detecting a change in magnetic field due to eddy currents produced in a coin and identifying the coin on the basis of the detected change includes a path along which the coin moves, a sensor including two coils juxtaposed at a predetermined interval along the path and disposed such that a central axis of each of the two coils is in line with a direction perpendicular to an obverse or reverse of the coin moving along the path, and two magnetic impedance elements disposed respectively within the two coils to extend along the central axes of the two coils, and an identification circuit for outputting an identification signal for identification of the coin by differentially amplifying outputs of the two magnetic impedance elements.

22 Claims, 8 Drawing Sheets

COIN IDENTIFICATION DEVICE FOR IDENTIFYING A COIN ON THE BASIS OF CHANGE IN MAGNETIC FIELD DUE TO EDDY CURRENTS PRODUCED IN THE COIN

BACKGROUND OF THE INVENTION

1. Field of the Invention

The present invention relates to a coin identification device for identifying the kind of a coin in an automatic vending machine or the like, and more particularly to a novel coin identification device which uses a magnetic impedance element and which is capable of distinguishing the projections or depressions of a surface design of the coin in addition to the material, thickness and diameter of the coin, which are hitherto distinguishable by the conventional coin identification device.

2. Description of Related Art

The conventional coin identification device is configured to identify a coin by means of a so-called eddy-current magnetic sensor. In the eddy-current magnetic sensor, an alternating current is made to flow to a coil which is connected to an oscillation circuit, thereby generating an alternating magnetic field, which is then applied to the coin. In this instance, an eddy current is produced in the coin by electromagnetic induction, causing a change in the magnetic field. As a result, the impedance of the coil changes to cause a change in amplitude or frequency of the oscillation circuit, so that the change in the magnetic field can be detected. Data about the material, thickness and diameter of the coil is obtained from the detection output thus obtained from the oscillation circuit and is used for the identification of the kind of the coin. The coil is either an air-core coil or a coil having a magnetic core made of a ferrite material and is disposed either on one side or both sides of a path along which the coin moves.

Coin identification devices are used mainly for automatic vending machines for vending tickets, cooling drinks, cigarettes, etc. However, the number of cases where some foreign coins are erroneously recognized by the automatic vending machines has recently increased. As mentioned above, the kind of a coin is discriminated from other kinds on the basis of data of material, thickness and diameter of the coil obtained from the detection output of the eddy-current magnetic sensor. However, some of foreign coins closely resemble some of domestic coins in material and in outside dimension. Such a foreign coin is apt to be mistaken for a domestic coin and allowed to pass the coin identification device. Therefore, it has become necessary to more accurately discriminate similar coins by adding a new function to the conventional coin identifying method.

To meet this requirement, it is conceivable as a new identifying method to distinguish the presence or absence and/or size of projections or depressions of a surface design carved on an obverse or reverse of the coin. However, in order to distinguish the projections or depressions of the surface design of the coin or the stepped edges of the coin by using the conventional eddy-current magnetic sensor, the diameter of a magnetic field spot to be applied to the coin must be reduced to a diameter measuring several millimeters. However, the reduction in the range of the magnetic field to be applied causes the area where an eddy current is produced to become smaller. The change in the magnetic field expected then also becomes smaller accordingly. As a result, it becomes impossible to obtain an adequate S/N (signal-to-noise ratio) of the detection output.

BRIEF SUMMARY OF THE INVENTION

It is, therefore, an object of the invention to provide a coin identification device which is capable of accurately identifying a coin not only by distinguishing the material, thickness and diameter of the coin but also by detecting projections or depressions of a surface design of the coin by means of an element which gives a detection output with an adequate S/N.

In order to obtain an adequate S/N, it is necessary to use a highly sensitive magnetic detecting element for detection of a magnetic field. Some of magnetic impedance elements suited for this purpose are arranged, for example, as disclosed in Japanese Laid-Open Patent Application No. HEI 7-181239. The magnetic impedance element is configured to detect a magnetic field by utilizing a magnetic impedance effect, in which when a high-frequency current of a MHz (megahertz) band is applied to a magnetic substance such as an amorphous wire, a magnetic film or the like, the impedances of two ends of the magnetic substance varies by several-ten percents relative to an external magnetic field. Thus, the magnetic impedance element has an extremely high detecting power for detecting a magnetic field. Further, compared with a flux gate sensor, the magnetic impedance element has a smaller diamagnetic field and thus can be prepared to measure only several millimeters in length. Further, the magnetic impedance element has no variation of state due to magnetization.

To attain the above object, in accordance with an aspect of the invention, there is provided a coin identification device, utilizing such a magnetic impedance element, for detecting a change in magnetic field due to eddy currents produced in a coin and identifying the coin on the basis of the detected change, which comprises (a) a path along which the coin moves, (b) a sensor including two coils juxtaposed at a predetermined interval along the path and disposed such that a central axis of each of the two coils is in line with a direction perpendicular to an obverse or reverse of the coin moving along the path, and two magnetic impedance elements disposed respectively within the two coils to extend along the central axes of the two coils, and (c) an identification circuit for outputting an identification signal for identification of the coin by differentially amplifying outputs of the two magnetic impedance elements.

In accordance with another aspect of the invention, there is provided a coin identification sensor for detecting a change in magnetic field due to eddy currents produced in a coin and identifying the coin on the basis of the detected change, which comprises (a) two coils juxtaposed at a predetermined interval along a path along which the coin moves and disposed such that a central axis of each of the two coils is in line with a direction perpendicular to an obverse or reverse of the coin moving along the path, and (b) two magnetic impedance elements disposed respectively within the two coils to extend along the central axes of the two coils.

The above and other objects and features of the invention will become apparent from the following detailed description of embodiments thereof taken in connection with the accompanying drawings.

DETAILED DESCRIPTION OF THE INVENTION

Hereinafter, preferred embodiments of the invention will be described in detail with reference to the drawings.

(First Embodiment)

Figure 1A:
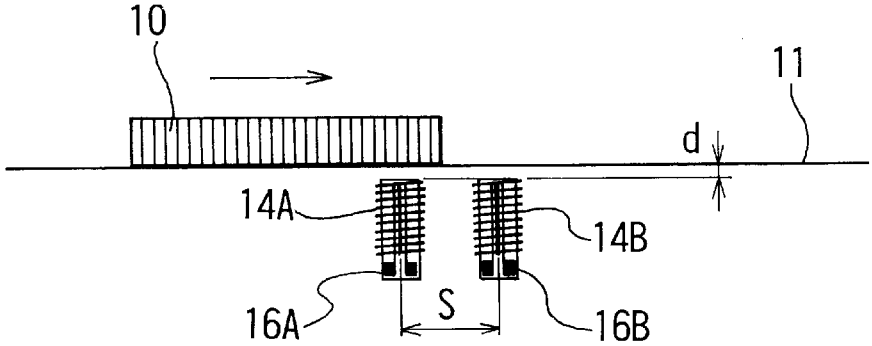
FIGS. 1(*a*), 1(*b*) and 1(*c*) show the structure and arrangement of a sensor part of a coin identification device according to a first embodiment of the invention.
Figure 1B:
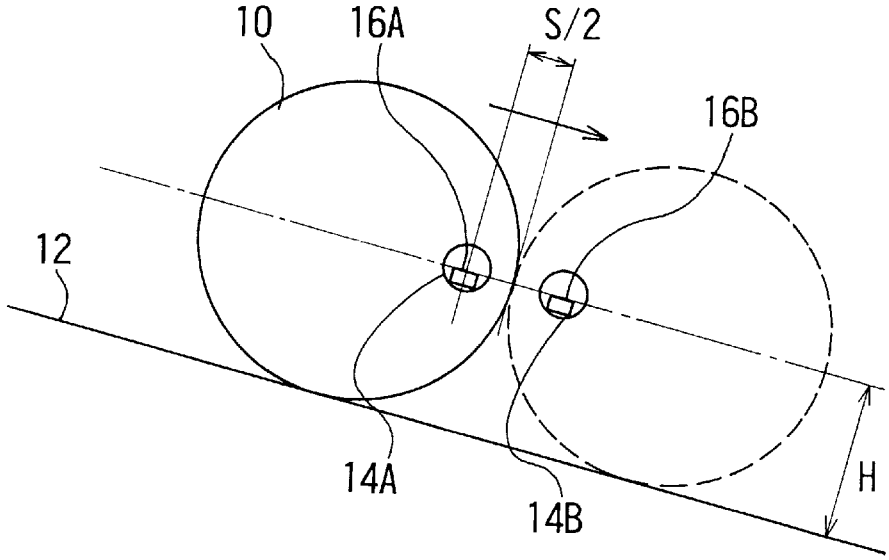
Figure 1C:
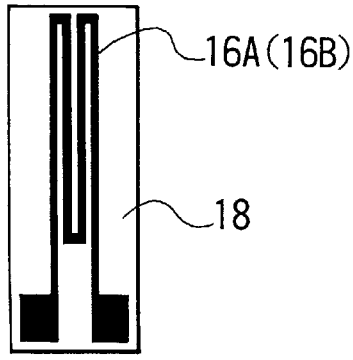
Figure 7:
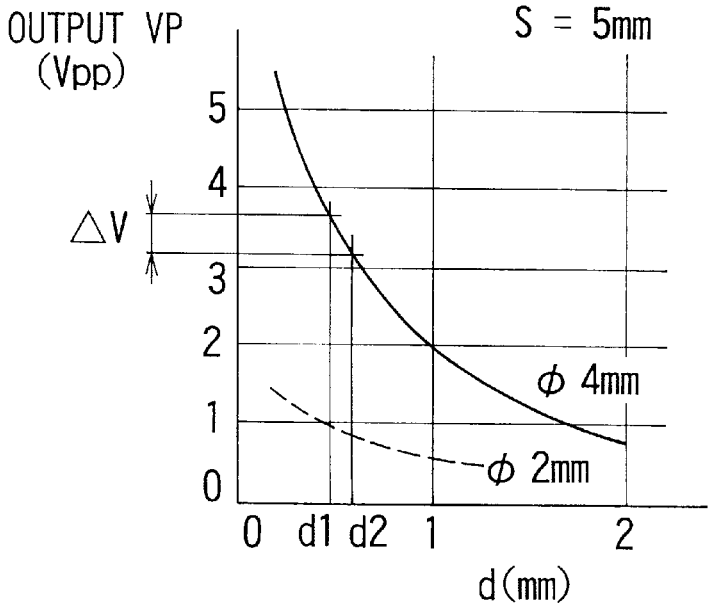
FIG. 7 is a graph showing the relationship between a distance "d" between a coin detecting surface and the sensor and the sensor output Vp.

A coin identification device according to a first embodiment of the invention is arranged as shown in FIGS. 1(*a*), 1(*b*) and 1(*c*) to FIG. 7. FIGS. 1(*a*), 1(*b*) and 1(*c*) are diagrams for explaining a sensor part of the coin identification device in the first embodiment. FIG. 1(*a*) shows the arrangement of the sensor part as viewed from above a path along which a coin moves. FIG. 1(*b*) shows the positional relationship between elements of the sensor part and the coin, as viewed from one side of the path along which the coin moves. FIG. 1(*c*) shows the configuration of the sensor part.

Referring to FIGS. 1(*a*), 1(*b*) and 1(*c*), a coin 10 moves in the direction of an arrow while rolling over the slanting surface 12 of a straight path 11. Although the coin 10 is arranged to fall along the slanting surface 12 in the case of the first embodiment, the arrangement may be changed to have the coin either horizontally moved by a belt or allowed to vertically fall.

Coils 14A and 14B for applying an alternating magnetic field are provided to produce eddy currents in the coin 10 and are each formed either in a cylindrical shape or a rectangular shape. The coils 14A and 14B are juxtaposed at a predetermined interval S (interval between their central axes) along the path 11 and are disposed on one side of the path 11 at a distance "d" from the path 11. The central axes of the coils 14A and 14B are in line with a direction perpendicular to the wall face of the path 11, i.e., a direction perpendicular to the obverse and reverse of the coin 10 moving along the path 11. The optimum values of the diameters of the coils 14A and 14B, the interval S and the distance "d" from the path 11 will be described later herein. Further, the height H of each of the coils 14A and 14B from the slanting surface 12 (height of the central axis of each coil) is preferably set at a value which is one half of the diameter of a coin which must be most accurately identified or distinguished among coins to be handled (the most expensive coin among them).

Magnetic impedance elements 16A and 16B employed as magnetic detecting elements (hereinafter referred to as MI elements) for detecting a change in magnetic field due to eddy currents are held respectively within the coils 14A and 14B in such a way as to extend along the central axes of the coils 14A and 14B. The reason for arranging the MI elements 16A and 16B along the central axes of the coils 14A and 14B lies in that the change in magnetic field due to eddy currents produced in the coin 10 most saliently takes place in the direction of the central axis of the magnetic field applied.

Each of the MI elements 16A and 16B is composed of a high permeability magnetic film of a patternized amorphous or fine-crystal film formed on an amorphous wire or on a nonmagnetic substrate made of a glass or ceramic material. In this case, however, the MI element 16A or 16B is composed of a high permeability magnetic film formed in a zigzag pattern on a nonmagnetic substrate 18, as shown in FIG. 1(*c*).

Figure 2:
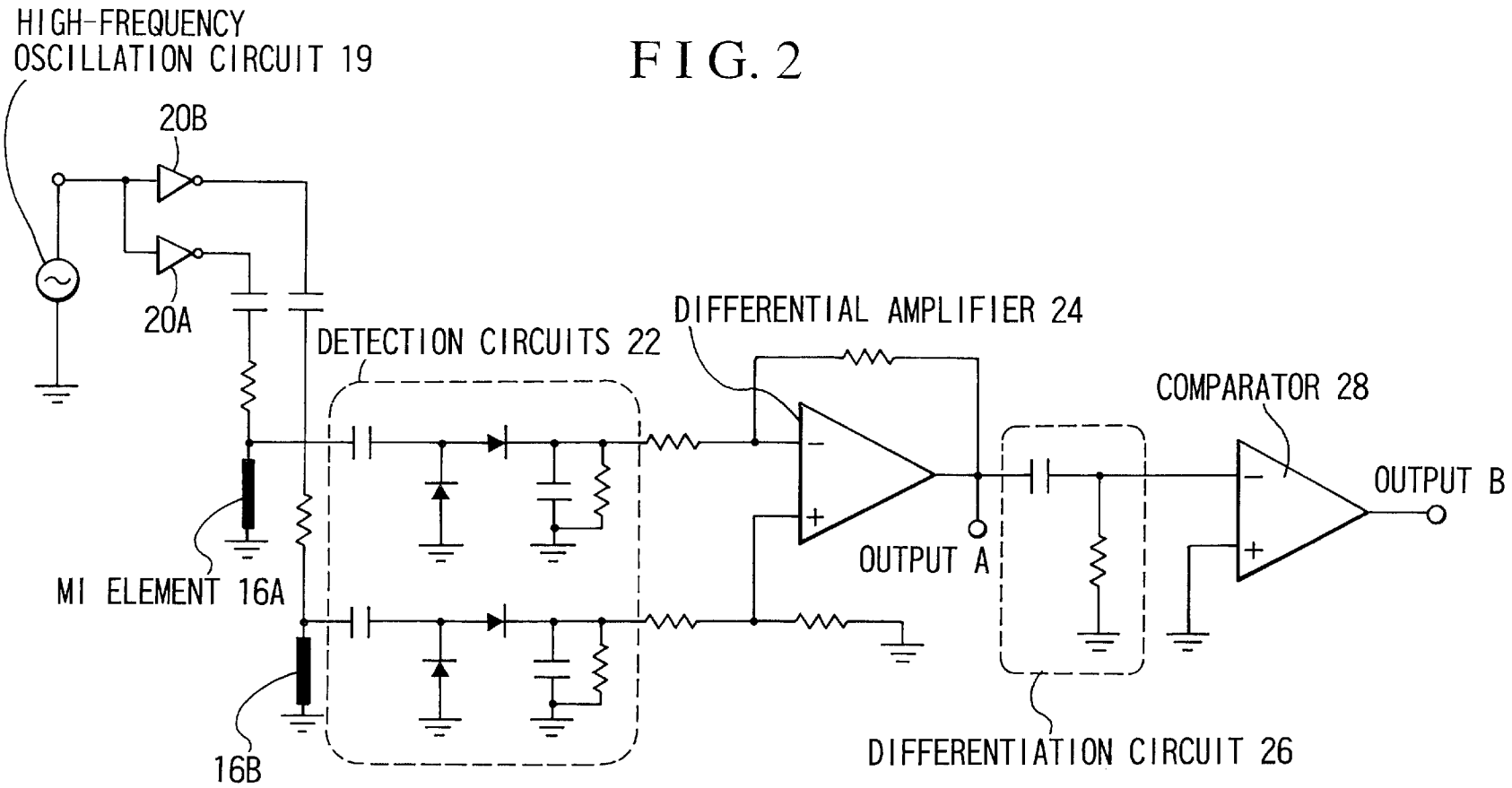
FIG. 2 is a circuit diagram showing a circuit for obtaining an identification signal for identifying a coin on the basis of a detection output for detection of a change in magnetic field obtained by driving magnetic impedance (MI) elements shown in FIG. 1(*a*).

FIG. 2 shows a circuit for obtaining an identification signal for identifying a coin on the basis of a detection output obtained by driving the MI elements 16A and 16B and detecting a change in magnetic field.

The impedance of each MI element changes according to a change taking place in an external magnetic field when a high-frequency current of a MHz band is applied. In the circuit arrangement shown in FIG. 2, the high-frequency current is applied from a high-frequency oscillation circuit 19 to the MI elements 16A and 16B through buffers 20A and 20B, capacitors provided for removal of DC components and resistors provided for adjustment of output impedance and adjustment of balance of differential inputs. One end of each of the MI elements 16A and 16B is grounded. The impedances of the MI elements 16A and 16B change according to changes in magnetic field due to eddy currents produced in the coin. Then, the voltage across two ends of each of the MI elements 16A and 16B changes accordingly, thereby obtaining a signal. The signals thus obtained from the MI elements 16A and 16B are supplied to two sets of detection circuits 22 and are taken out respectively as magnetic detection signals. The magnetic detection signals are supplied to a differential amplifier circuit 24 for differential amplification. As a result, a differential output A is obtained from the differential amplifier circuit 24, as a first identification signal.

Since each of the MI elements 16A and 16B has a strong detection sensitivity in the longitudinal direction thereof, any magnetic field that becomes a noise from outside is canceled by the differential detection, so that a magnetic field caused by the eddy currents alone can be detected with an adequate S/N. Information on the material of the coin is obtained from the differential output A, as will be described later herein.

Further, in the circuit arrangement shown in FIG. 2, the differential output A is differentiated by a differentiation circuit 26. The output of the differentiation circuit 26 is compared with a predetermined voltage of a value near a zero-cross point. As a result, a pulse output B is obtained from the comparator 28, as a second identification signal. Information on the diameter and projections or depressions of the coin is obtained from the pulse output B, as will be described later herein.

The fundamental operation of the above arrangement and the optimum conditions for the elements thereof are next described.

Figure 3A:
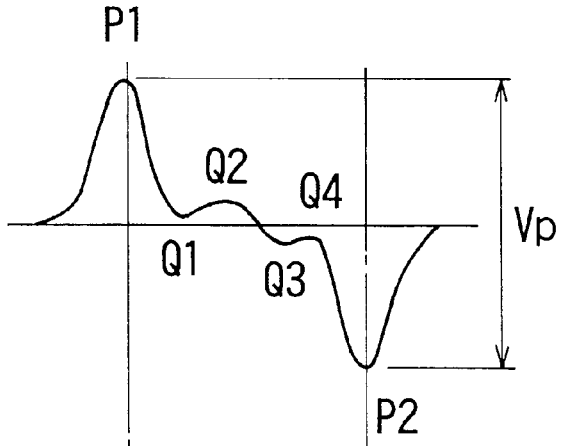
FIGS. 3(*a*), 3(*b*), 3(*c*) and 3(*d*) are waveform charts showing respectively the waveforms of outputs of a differential amplifier circuit, a differentiating circuit and a comparator shown in FIG. 2 and also the waveform of an output of the differential amplifier circuit obtained in the event of a coin having a hole.
Figure 3B:
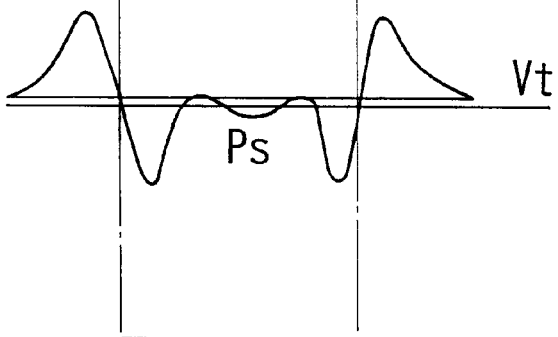
Figure 3C:
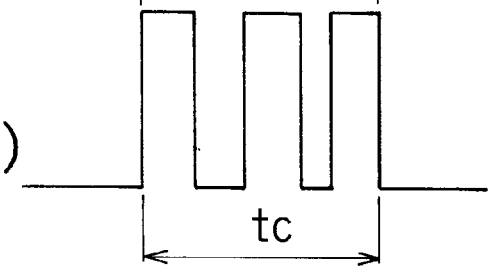
Figure 3D:
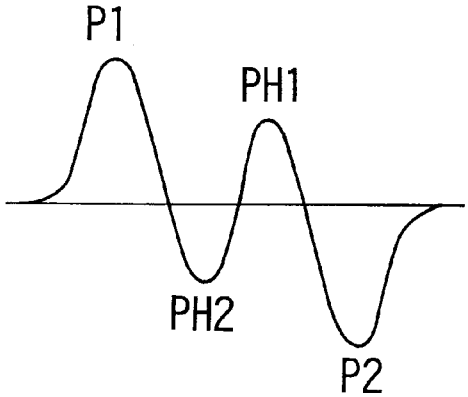

An alternating current of a predetermined frequency range from several-ten KHz to several-hundred KHz is first applied to the coils 14A and 14B to generate an alternating magnetic field. With the circuit shown in FIG. 2 driven in the above-stated manner, the coin 10 is made to move over the slanting surface 12 of the path 11, as shown in FIGS. 1(*a*) and 1(*b*). Then, as shown in FIG. 3(a), the differential output A is obtained in a waveform having large peaks at positive and negative poles. More specifically, when the coin 10 arrives at the coil 14A and the MI element 16A, a change in the magnetic field is brought about by the eddy currents produced in the coin 10. The change in the magnetic field causes the impedance of the MI element 16A to change. Then, there appears a difference in impedance between the MI element 16A and the other MI element 16B, so that the differential output A becomes larger. When the coin 10 is just in a position indicated by a full line in FIG. 1(*b*), the differential output A is at its positive pole peak P1 shown in FIG. 3(*a*). The differential output A is at its negative pole peak P2 shown in FIG. 3(*a*) when the coin 10 is in a position indicated by a broken line in FIG. 1(*b*).

In addition, in a case where the coin 10 has a hole, there are obtained another pair of conspicuous peaks PH1 and PH2 between the peaks P1 and P2 as shown in FIG. 3(*d*). The hole of the coin 10 thus can be easily detected.

Since the coils 14A and 14B and the MI elements 16A and 16B are juxtaposed along the moving direction of the coil 10, passing the coin 10 only once enables the coin identification device to carry out the eddy current measurement twice. Then, by capturing a peak-to-peak output Vp, an output indicating a sum of the results of the two measuring steps is automatically obtained, so that measurement errors can be minimized.

When the differential output A is at the peak P1 or P2, one of the MI elements 16A and 16B is at a distance S/2 from the edge of the coin 10 as shown in FIG. 1(*b*). Then, the output Vp reflects an output obtained by measuring the eddy currents at a point located inward as much as the distance S/2 from the edge of the coin 10. According to the results of examination of various coins, an area of each coin located 1.5 mm to 3 mm away from its edge has no surface design or has little projections or depressions. Therefore, taking into consideration some fluctuations of the output, the interval S between the coils 14A and 14B, or between the MI elements 16A and 16B, is preferably set within a range from 3 mm to 6 mm.

Since the output Vp corresponds to the magnitude of the eddy currents which vary according to a difference in resistance among different coin materials, the material of the coin is distinguishable by the magnitude of the output Vp.

In order to optimize the sensitivity of the output Vp, it is important to appositely select the current to be applied to the coils 14A and 14B which also determine bias magnetic fields for the MI elements 16A and 16B, the diameters of the coils 14A and 14B, and a distance between the sensor part and the coin detecting part. The optimum conditions for these factors are as described below.

Figure 4:
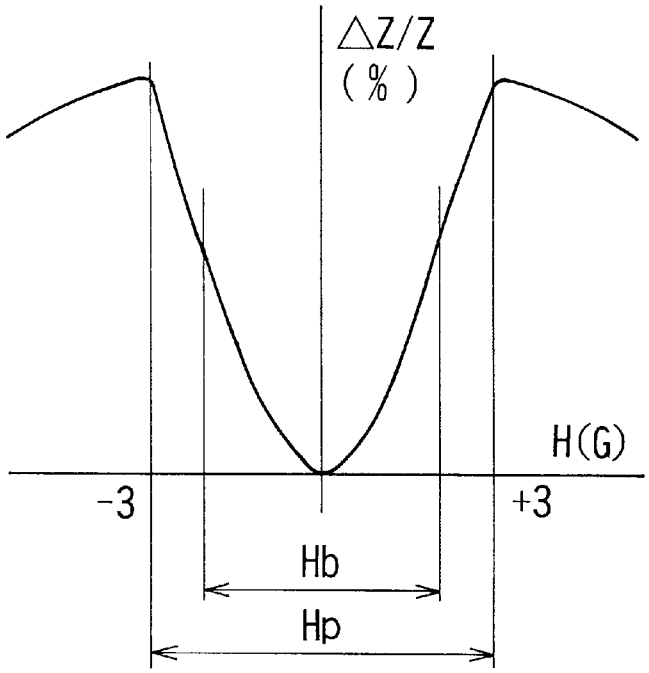
FIG. 4 is a graph showing the magnetic impedance characteristic of the MI (magnetic impedance) element.

The current to be applied to the coils 14A and 14B is first described as follows. The coils 14A and 14B are arranged not only to supply the alternating magnetic field to the coin 10 but also to play the role of determining bias magnetic fields for the MI elements 16A and 16B. FIG. 4 shows the impedance characteristic of an MI element used for a test. As shown, the MI element has a double-humped characteristic which symmetrically has peaks at ±3 gauss points and a maximum sensitivity of 12%/gauss.

Figure 5:
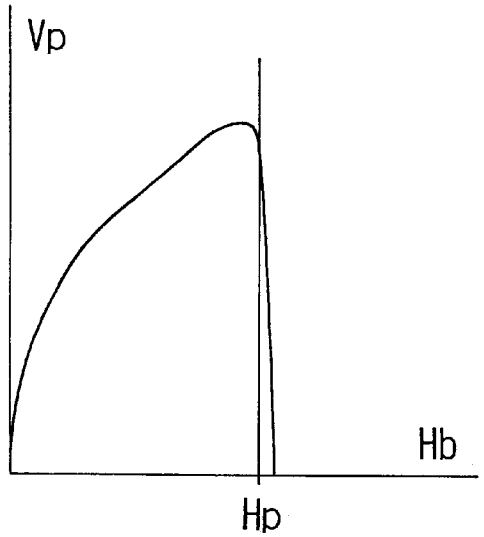
FIG. 5 is a graph showing the relationship between the magnitude of an alternating magnetic field Hb generated by a coil shown in FIG. 1(*a*) and a sensor output Vp.

The maximum value of the alternating magnetic field Hb generated by the coils 14A and 14B and the above-stated sensor output Vp are in a relation shown in FIG. 5. If the alternating magnetic field Hb is applied at a value above a magnetic field Hp which causes the peak of change in maximum impedance of the magnetic impedance characteristic, the output Vp suddenly drops. In view of this, the current to be applied to the coils 14A and 14B must be set in such a way as to have the alternating magnetic field not exceeding the magnetic field Hp. The lower limit of the alternating magnetic field Hb is preferably set at a value which is at least ±0.5 gauss, because an external disturbing magnetic field such as earth's magnetism (about 0.5 gauss) is expected. The alternating current to be applied to the coils 14A and 14B is, therefore, preferably set at such a value that gives the absolute value of the alternating magnetic field Hb not less than 0.5 gauss and not greater than the value of the magnetic field Hp.

Figure 6:
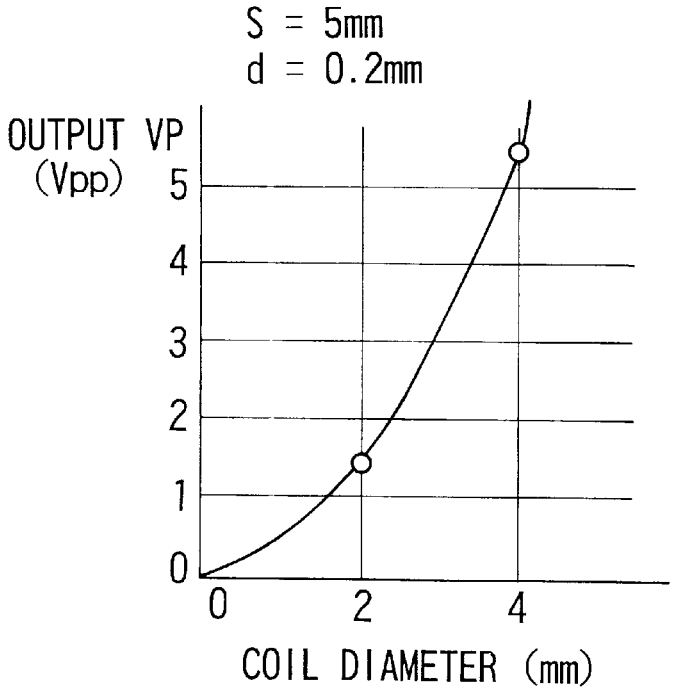
FIG. 6 is a graph showing the relationship between the diameter of the coil and the sensor output Vp.

As regards the diameter of each of the coils 14A and 14B, the coil diameter has a great influence over the magnitude of the eddy currents on the detecting surface (the obverse or reverse) of the coin 10. As shown in FIG. 6, the sensor output Vp varies approximately in proportion to the opening area of the coil determined by the coil diameter. Therefore, if the coil diameter is too small, the sensitivity of the sensor output is lowered. With the necessity of having a certain amount of measuring distance "d" taken into consideration, a coil diameter less than 2 mm is not practical. The coil diameter has no upper limit with respect to sensitivity. However, it is necessary to set the upper limit of the coil diameter from the viewpoint of detecting projections or depressions of a surface design of the coin, as will be described later.

The condition for selecting the distance between the detecting surface of the coin and the sensor part is as follows. The output of the sensor part decreases when the distance "d" shown in FIG. 1(*a*) increases, as shown in FIG. 7. This is because the magnetic field obtained on the detecting surface of the coin becomes smaller and the eddy currents decrease accordingly if the distance "d" increases. An adequate S/N is attainable, despite an increase in the distance "d", if the coil diameter is made larger. The coil diameter, however, must be arranged to be smaller for the purpose of detecting projections or depressions of a surface design of the coin. Therefore, it is necessary to make the distance "d" as small as possible.

The sensitivity of the sensor output can be optimized by adequately selecting the above-stated three factors.

Next, the detection of projections or depressions of a surface design of the coin is described. First, the relationship between the projections or depressions of the coin and the sensor output is described as follows.

Referring to FIG. 3(*a*) which shows the waveform of the sensor output, small peaks Q1 to Q4 between the peaks P1 and P2 are caused by projections or depressions of the obverse or reverse of the coin. These small peaks appear in different manners according to the amounts and positions of the projections or depressions of the obverse or reverse of the coin. No small peaks, such as the small peaks Q1 to Q4, appear when a metal disk having neither projection nor depression is passed.

Various design patterns are carved on the surfaces of coins. The amount of the projection or depression of the carved surface design measures approximately 0.1 mm to 0.3 mm at the most. Such an amount of the projection or depression of the carved surface design causes a difference between distances d1 and d2 between the coil 14A or 14B and the confronting detecting parts of the coin, so that the sensor output exhibits peaks of the output waveform such as the peaks Q1 to Q4.

The above-stated data shown in FIG. 7 represents, as the output VP, changes in magnetic field due to eddy currents produced in the detecting parts of the coin at the distance "d" with a state of having no surface design on the coin used as datum. An output resulting from a difference between the distances d1 and d12 between the coil 14A or 14B and the confronting detecting parts of the coin appears as an output ΔV in FIG. 7.

Referring to FIG. 6, as apparent from the comparison of two cases of coil diameters ϕ2 mm and ϕ4 mm, a larger coil diameter gives a greater change in the output VP at the distance "d"and thus permits to obtain the output ΔV at a greater value. This data indicates that, in order to enhance the sensitivity for detection of projections or depressions of the coin, it is required to increase the coil diameter and to decrease the distance "d" to the detecting surface (the wall face of the path 11 on the side of the coil, or the obverse or reverse of the coin).

However, if the coil diameter is increased too much, the projections or depressions within a magnetic field spot on the detecting surface of the coin would be uniformalized, thereby making the difference between the distances d1 and d2 smaller. Besides, the upper limit for the coil diameter is also restricted by the interval S required between adjacent coils for differential detection. Considering also the size of the design patterns of the coin and considering that a practicable upper limit of the interval between the MI elements is 6 mm, the coil diameter must be decided to be not greater than 6 mm. Therefore, with the above-stated minimum coil diameter of 2 mm for sensitivity also taken into consideration, the coil diameter is preferably set at a value between 2 mm and 6 mm.

The method for measuring the diameter of a coin and distinguishing the projections or depressions of the coin is next described.

When the waveform of the differential output A shown in FIG. 3(*a*) is differentiated by the differentiation circuit 26 included in the circuit arrangement shown in FIG. 2, a differential waveform is obtained as shown in FIG. 3(*b*). Further, when this differential waveform is compared by the comparator 28 with a predetermined voltage near a zero-cross point, a pulse output B is obtained as shown in FIG. 3(*c*).

The coin which gives the above waveform has a projection measuring about 0.2 mm at the central part of the detecting surface thereof. In the differential waveform shown in FIG. 3(*b*), there appears, at the middle part thereof, a peak Ps corresponding to the projection. When the waveform shown in FIG. 3(*b*) is compared with a predetermined voltage between the peak value and the ground value, there are obtained three pulses as shown in FIG. 3(*c*). The left end of the three pulses approximately corresponds to the peak P1 of the waveform shown in FIG. 3(*a*), and the right end of the three pulses corresponds to the peak P2. A period of time tc between the left and right ends of the three pulses indicates the passing time of the coin to be used in measuring the diameter of the coin.

More specifically, the period of time tc approximately corresponds to a period of time required for the coin 10 to move by a distance corresponding to the diameter of the coin 10, i.e., a distance from the position illustrated by the full line to the position illustrated by the broken line in FIG. 1(*b*). With the moving speed of the coin 10 assumed to be known beforehand and to be constant, the diameter of the coin 10 can be obtained by a computing operation expressed as "(moving speed)×(period of time tc)".

Further, the projections or depressions of the coin are distinguishable by using information on the number, widths and positions of the pulses of the comparator output. For example, only two pulses are obtained if the coin has little projections or depressions (small differences in height). On the other hand, if the coin has one high projection at its central part, a signal having three pulses is obtained. Further, with the exception of the two end pulses, pulses corresponding to projections or depressions of a surface design of the coin permit comparison of the sizes and positions of the projections or depressions of the surface design according to the size and position of those pulses.

As described above, the arrangement for distinguishing the projections or depressions of a coin is added as a new condition for identification of the coin. Therefore, there can be provided an accurate and reliable coin identification device.

(Second Embodiment)

The first embodiment described above is the basic arrangement for identifying a coin on the basis of a change in magnetic field due to eddy currents produced in the coin, by using the MI elements. However, for practical use, the coin identification device must be arranged to measure both the obverse and reverse of a coin and also the thickness of the coin by passing the coin only once. To meet this requirement, two sensor parts which are each configured in the above-stated manner must be disposed respectively on both sides of the path along which the coin moves, one sensor part on one side and the other sensor part on the other side of the path. Such an arrangement is attained in a second embodiment of the invention as follows.

Figure 8A:
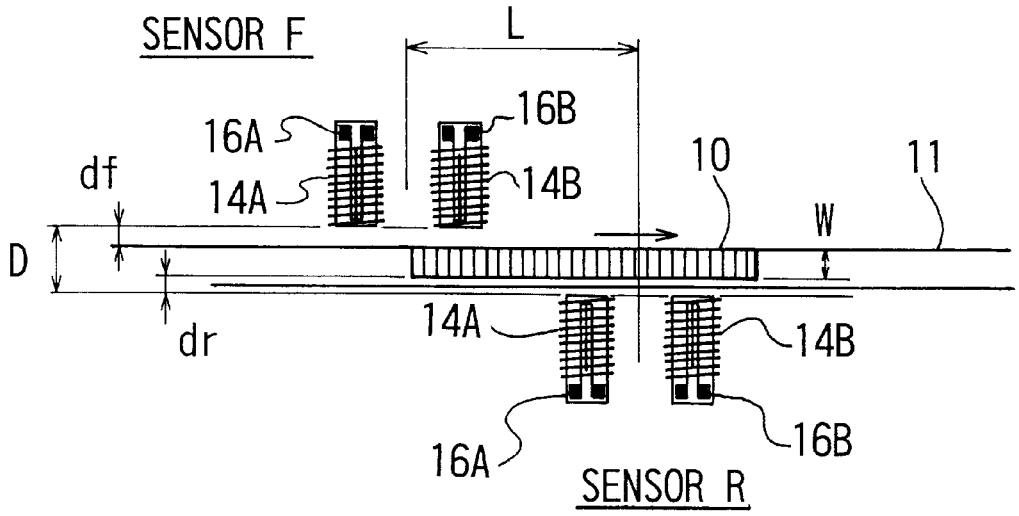
FIGS. 8(*a*) and 8(*b*) show the structure and arrangement of a sensor part of a coin identification device according to a second embodiment of the invention.
Figure 8B:
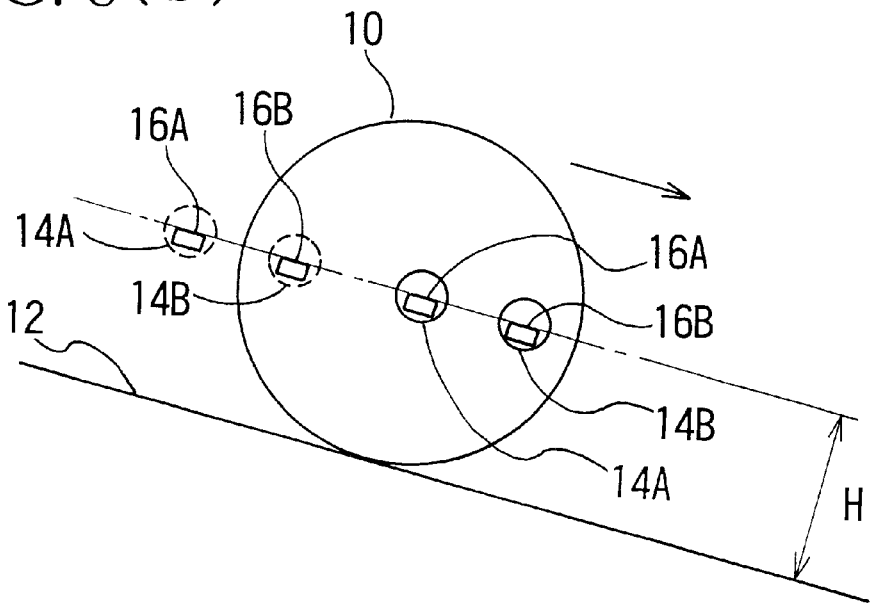

FIGS. 8(*a*) and 8(*b*) show the arrangement of the second embodiment. In the second embodiment, a sensor part which is composed of the coils 14A and 14B and the MI elements 16A and 16B configured in the same manner as in the first embodiment described in the foregoing is disposed in two sets as sensors F and R. As shown in FIGS. 8(*a*) and 8(*b*), the sensors F and R are disposed respectively on both sides of the path 11 along which the coin 10 moves. In the moving direction of the coin 10, the positions of the sensors F and R are spaced as much as a predetermined distance L.

With the second embodiment arranged in this manner, data about both the obverse and reverse of the coin can be obtained by passing the coin only once. In addition to that advantage, information on the thickness and very accurate information on the diameter of the coin can be obtained. The thickness of the coin can be detected in the following manner.

For example, in a case where the coin 10 moves along the path 11 while being kept in contact with a wall face of the path 11 on the side of the sensor F, as shown in FIG. 8(*a*), a distance df between the sensor F and the detecting surface of the coin 10 on the side of the sensor F becomes constant. In this state, the output of the sensor F remains unchanged irrespective of the thickness W of the coin 10. On the side of the other sensor R, however, a distance dr between the sensor R and the detecting surface of the coin 10 on the side of the sensor R varies according to the thickness of the coin 10. Then, the output of the sensor R varies in a manner which corresponds to the graph of FIG. 7. As a result, the information on the thickness of the coin 10 is obtained on the side of the sensor R.

Further, in another case where the coin 10 moves not always remaining in contact with the wall face of the path 11 on the side of the sensor F, an operation of adding up the outputs of the two sensors F and R can remove any adverse effect of the buoyantly moving state of the coin 10, as an increase in one of the distances df and dr can be almost completely offset by a decrease in the other distance, so that information on the thickness of the coin 10 can be obtained from the result of the adding operation.

Figure 9:
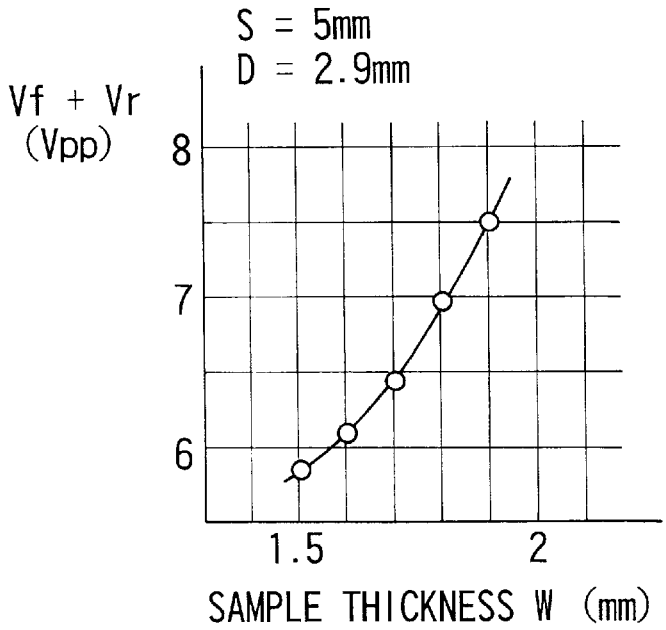
FIG. 9 is a graph showing the relationship between the thickness W of a metal disk sample which is used in place of the coin and a sum (Vf+Vr) of the outputs of sensors F and R shown in FIG. 8(*a*).

FIG. 9 shows the results of tests, in which a plurality of disks made of one and the same metal material but differing in thickness from each other are prepared and made to move in the coin identification device according to the second embodiment. In FIG. 9, the sum (Vf+Vr) of the outputs Vf and Vr of the sensors F and R is shown in relation to the thickness W of the disk. As apparent from the results of tests shown in FIG. 9, an output which corresponds to the thickness data can be obtained with little fluctuations, in accordance with the arrangement of the second embodiment.

Further, in the second embodiment, the diameter of a coin is accurately measured irrespective of the moving speed of the coin. In the case of the first embodiment, it is necessary to arrange the coin to move at a constant speed, because the measurement of the diameter of the coin is affected directly by the variety of moving speeds of the coin. This problem is solved by the second embodiment. In the second embodiment, the diameter of the coin is measured in the following manner.

Figure 10:
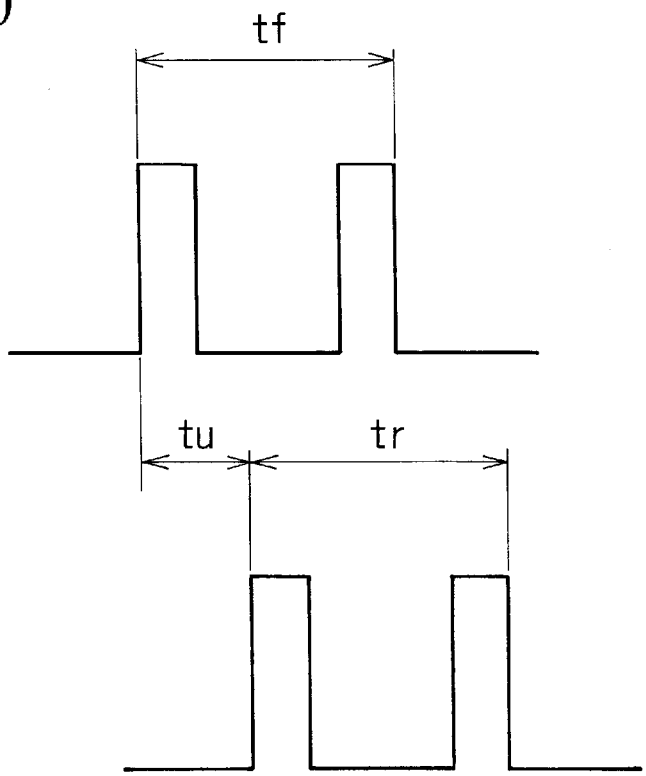
FIG. 10 is a waveform chart showing the outputs of comparators of the sensors F and R.

FIG. 10 shows the comparator outputs of the sensors F and R corresponding to the output B shown in FIG. 2. Referring to FIG. 10, the moving speed (V=L/tu) of a coin is obtained from a time difference tu between the rises of the leading pulses of the sensors F and R and the distance L between the sensors F and R, every time the coin is passed. The diameter of the coin is obtained from a product of the moving speed V of the coin and a period of time tf or tr corresponding to the period of time between the peaks P1 and P2 of the sensor F or R shown in FIG. 3(*a*), i.e., the period of time tc shown in FIG. 3(*c*). Since the moving speed V of the coin is thus obtained every time the coin is passed, the diameter of each coin can be accurately measured without being affected by the moving speed of the coin.

Figure 11:
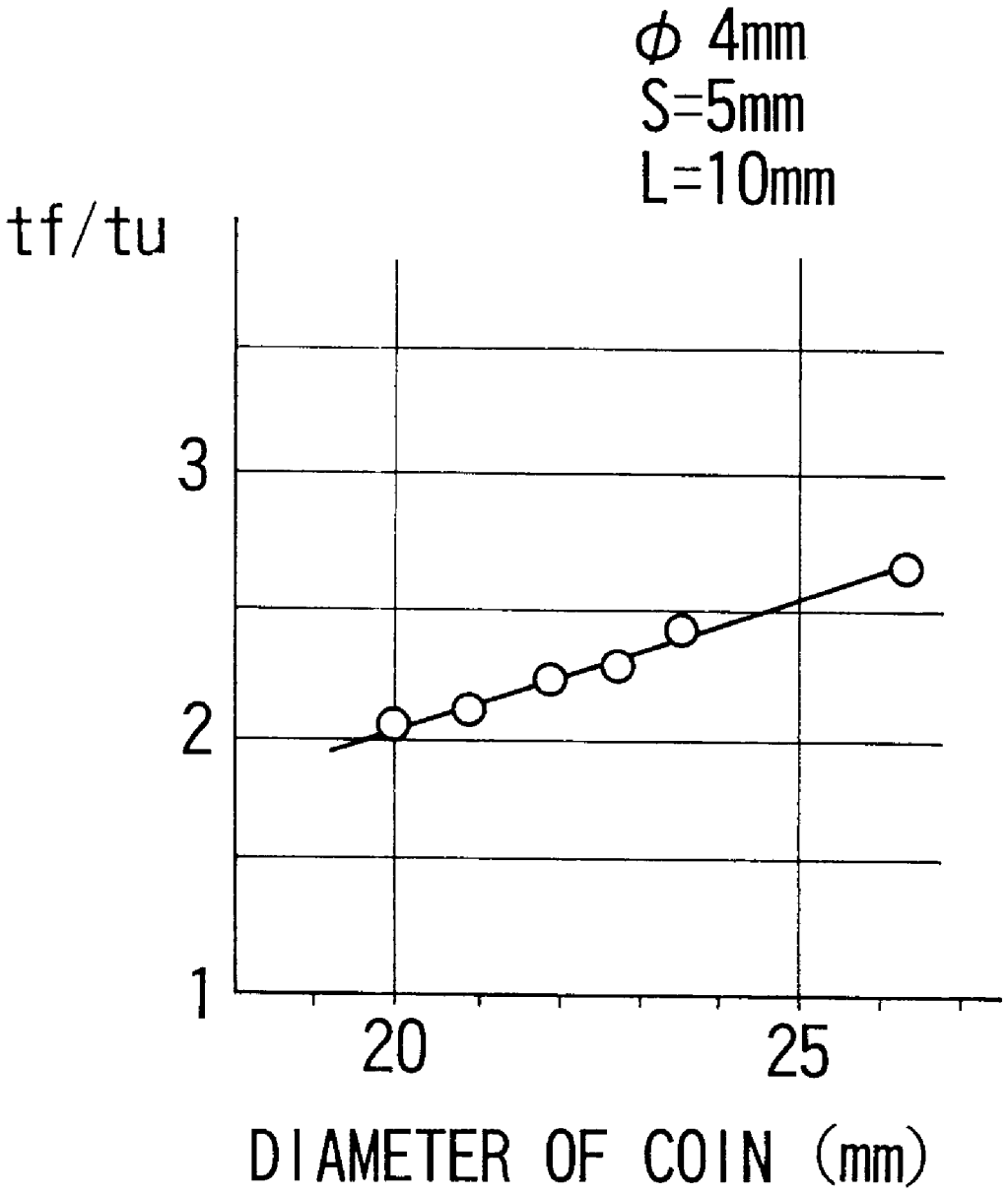
FIG. 11 is a graph showing the correlation between the diameter of a coin and a ratio (tf/tu) between time periods tf and tu shown in FIG. 10.

In addition, FIG. 11 shows a correlation between the diameter of the coin and a ratio tf/tu between periods of time tf and tu shown in FIG. 10. As apparent from FIG. 11, data about the diameter of the coin can be adequately obtained in the second embodiment. Since the ratio tf/tu between the periods of time tf and tu is equal to the value of "(the diameter of the coin)/(the distance L between the sensors)", the diameter of the coin can be evaluated (determined) by examining the ratio tf/tu between the periods of time tf and tu, with the distance L between the sensors used as a reference value. Further, additional use of data of a ratio tr/tu to obtain an average value lessens any error resulting from changes taking place in the moving speed of the coin while the coin is in process of being passed. Further, a trouble such as sticking of the coin in the path can be detected by monitoring any change in the ratio tr/tu from the ratio tf/tu.

As apparent from the foregoing description, there is provided a coin identification device arranged to apply an alternating magnetic field to a coin, to detect changes in the magnetic field due to eddy currents produced in the coin and to identify the coin on the basis of the result of the detection. The coin identification device includes a sensor part composed of two coils juxtaposed at a predetermined interval along a path along which the coin moves and disposed such that a central axis of each of the two coils is in line with a direction perpendicular to an obverse and reverse of the coin moving along the path, and two magnetic impedance (MI) elements disposed respectively within the two coils in such a way as to extend along the central axes of the coils. The coin identification device is thus arranged to apply an alternating magnetic field to the coin by allowing an alternating current to flow to the two coils, to detect changes in the magnetic field due to eddy currents produced in the coil by means of the two MI elements, and to obtain an identification signal for the coin by differentially amplifying the outputs of the two MI elements. Accordingly, changes in the magnetic field due to the eddy currents can be detected with a high degree of sensitivity and with an adequate S/N. Since the spot diameter of the magnetic field applied to the coil can be arranged to be a small diameter, not only information on the material and diameter of the coil but also information about projections or depressions of a surface design of the coin can be obtained from the identification signal obtained through the differential amplification process, so that the identification of coins can be more accurately performed.

Further, if two sensor parts as the sensor part configured in the manner as described above are disposed respectively on both sides of the path along which the coin moves, in such a manner that the positions of the two sensor parts deviate from each other by a predetermined distance in the moving direction of the coin, both the obverse and reverse of the coin can be detected by passing the coin once. Further, information on the thickness of the coin can be detected, and the measuring accuracy for the diameter of the coin can be enhanced. Thus, a coin identification device which excels in accuracy and reliability can be provided.

What is claimed is:

1. A coin identification device for detecting a change in magnetic field due to eddy currents produced in a coin and identifying the coin on the basis of the detected change, said coin identification device comprising:

(a) a path along which the coin moves;

(b) a sensor including:

two coils juxtaposed at a predetermined interval along said path and disposed such that a central axis of each of said two coils is in line with a direction perpendicular to an obverse or reverse of the coin moving along said path; and two magnetic impedance elements disposed respectively within said two coils to extend along the central axes of said two coils; and (c) an identification circuit for outputting an identification signal for identification of the coin by differentially amplifying outputs of said two magnetic impedance elements, wherein each of an interval between said two coils and an interval between said two magnetic impedance elements is within a range from 3 mm to 6 mm.

2. A coin identification device according to claim 1, wherein said sensor includes two sensors disposed respectively on both sides of said path, and positions of said two sensors deviate from each other by a predetermined distance in a moving direction of the coin.

3. Coin identification device according to claim 1, wherein an alternating current to be applied to said two coils is set at such a value that an absolute value of a maximum value of an alternating magnetic field generated by each of said two coils is not less than 0.5 gauss and not greater than a value of a magnetic field which causes a peak of changes in impedance of each of said two magnetic impedance elements.

4. Coin identification device according to claim 1, wherein each of said two coils has a diameter within a range from 2 mm to 6 mm.

5. Coin identification device according to claim 1, further comprising means for differentiating the identification signal, then, comparing the differentiated identification signal with a predetermined voltage to convert the identification signal into a pulse output, and obtaining information on projections or depressions of the obverse or reverse of the coin on the basis of the number of pulses or width of pulses of the pulse output.

6. A coin identification device for detecting a change in magnetic field due to eddy currents produced in a coin and identifying the coin on the basis of the detected change, said coin identification device comprising:

(a) a path along which the coin moves;

(b) a sensor including:

two coils juxtaposed at a predetermined interval along said path and disposed such that a central axis of each of said two coils is in line with a direction perpendicular to an obverse or reverse of the coin moving along said path; and two magnetic impedance elements disposed respectively within said two coils to extend along the central axes of said two coils; and (c) an identification circuit for outputting an identification signal for identification of the coin by differentially amplifying outputs of said two magnetic impedance elements, wherein an alternating current to be applied to said two coils is set at such a value that an absolute value of a maximum value of an alternating magnetic field generated by each of said two coils is not less than 0.5 gauss and not greater than a value of a magnetic field which causes a peak of changes in impedance of each of said two magnetic impedance elements.

7. A coin identification device according to claim 6, wherein each of said two coils has a diameter within a range from 2 mm to 6 mm.

8. A coin identification device according to claim 6, further comprising means for differentiating the identification signal, then, comparing the differentiated identification signal with a predetermined voltage to convert the identification signal into a pulse output, and obtaining information on projections or depressions of the obverse or reverse of the coin on the basis of the number of pulses or width of pulses of the pulse output.

9. A coin identification device for detecting a change in magnetic field due to eddy currents produced in a coin and identifying the coin on the basis of the detected change, said coin identification device comprising:

(a) a path along which the coin moves;

(b) a sensor including:

two coils juxtaposed at a predetermined interval along said path and disposed such that a central axis of each of said two coils is in line with a direction perpendicular to an obverse or reverse of the coin moving along said path; and two magnetic impedance elements disposed respectively within said two coils to extend along the central axes of said two coils; and (c) an identification circuit for outputting an identification signal for identification of the coin by differentially amplifying outputs of said two magnetic impedance elements, wherein each of said two coils has a diameter within a range from 2 mm to 6 mm.

10. A coin identification device according to claim 9, further comprising means for differentiating the identification signal, then, comparing the differentiated identification signal with a predetermined voltage to convert the identification signal into a pulse output, and obtaining information on projections or depressions of the obverse or reverse of the coin on the basis of the number of pulses or width of pulses of the pulse output.

11. A coin identification device for detecting a change in magnetic field due to eddy currents produced in a coin and identifying the coin on the basis of the detected change, said coin identification device comprising:

(a) a path along which the coin moves;

(b) a sensor including:

two coils juxtaposed at a predetermined interval along said path and dispose such that a central axis of each of said two coils is in line with a direction perpendicular to an obverse or reverse of the coin moving along said path; and two magnetic impedance elements disposed respectively within said two coils to extend along the central axes of said two coils; and (c) an identification circuit for outputting an identification signal for identification of the coin by differentially amplifying outputs of said two magnetic impedance elements, further comprising means for differentiating the identification signal, then, comparing the differentiated identification signal with a predetermined voltage to convert the identification signal into a pulse output, and obtaining information on projections or depressions of the obverse or reverse of the coin on the basis of the number of pulses or width of pulses of the pulse output.

12. A coin identification sensor for detecting a change in magnetic field due to eddy currents produced in a coin and identifying the coin on the basis of the detected change, said coin identification sensor comprising:

(a) two coils juxtaposed at a predetermined interval along a path which the coin moves and disposed such that a central axis of each of said two coils is in line with a direction perpendicular to an obverse or reverse of the coin moving along the path; and (b) two magnetic impedance elements disposed respectively within said two coils to extend along the central axes of said two coils, wherein each of an interval between said two coils and an interval between said two magnetic impedance elements is within a range from 3 mm to 6 mm.

13. A coin identification sensor according to claim 12, wherein said sensor includes two sensors disposed respectively on both sides of said path, and positions of said two sensors deviate from each other by a predetermined distance in a moving direction of the coin.

14. A coin identification device according to claim 12, wherein an alternating current to be applied to said two coils is set at such a value that an absolute value of a maximum value of an alternating magnetic field generated by each of said two coils is not less than 0.5 gauss and not greater than a value of a magnetic field which causes a peak of changes in impedance of each of said two magnetic impedance elements.

15. A coin identification device according to claim 12, wherein each of said two coils has a diameter within a range from 2 mm to 6 mm.

16. A coin identification device according to claim 12, further comprising an identification circuit for outputting an identification signal for identification of the coin by differentially amplifying outputs of said two magnetic impedance elements.

17. A coin identification sensor for detecting a change in magnetic field due to eddy currents produced in a coin and identifying the coin on the basis of the detected change, said coin identification sensor comprising:

(a) two coils juxtaposed at a predetermined interval along a path which the coin moves and disposed such that a central axis of each of said two coils is in line with a direction perpendicular to an obverse or reverse of the coin moving along the path; and (b) two magnetic impedance elements disposed respectively within said two coils to extend along the central axes of said two coils, wherein an alternating current to be applied to said two coils is set at such a value that an absolute value of a maximum value of an alternating magnetic field generated by each of said two coils is not less than 0.5 gauss and not greater than a value of a magnetic field which causes a peak of changes in impedance of each of said two magnetic impedance elements.

18. A coin identification device according to claim 17, wherein each of said two coils has a diameter within a range from 2 mm to 6 mm.

19. A coin identification device according to claim 17, further comprising an identification circuit for outputting an identification signal for identification of the coin by differentially amplifying outputs of said two magnetic impedance elements.

20. A coin identification sensor for detecting a change in magnetic field due to eddy currents produced in a coin and identifying the coin on the basis of the detected change, said coin identification sensor comprising:

(a) two coils juxtaposed at a predetermined interval along a path which the coin moves and disposed such that a central axis of each of said two coils is in line with a direction perpendicular to an obverse or reverse of the coin moving along the path; and (b) two magnetic impedance elements disposed respectively within said two coils to extend along the central axes of said two coils, wherein each of said two coils has a diameter within a range from 2 mm to 6 mm.

21. A coin identification device according to claim 20, further comprising an identification circuit for outputting an identification signal for identification of the coin by differentially amplifying outputs of said two magnetic impedance elements.

22. A coin identification sensor for detecting a change in magnetic field due to eddy currents produced in a coin and identifying the coin on the basis of the detected change, said coin identification sensor comprising:

(a) two coils juxtaposed at a predetermined interval along a path which the coin moves and disposed such that a central axis of each of said two coils is in line with a direction perpendicular to an obverse or reverse of the coin moving along the path; and (b) two magnetic impedance elements disposed respectively within said two coils to extend along the central axes of said two coils, further comprising an identification circuit for outputting an identification signal for identification of the coin by differentially amplifying outputs of said two magnetic impedance elements.

* * * * *

UNITED STATES PATENT AND TRADEMARK OFFICE

CERTIFICATE OF CORRECTION

PATENT NO. : 6,068,102
DATED : May 30, 2000
INVENTOR(S) : Masahiro Kawase

It is certified that error appears in the above-identified patent and that said Letters Patent is hereby corrected as shown below:

Column 7,
Line 15, delete "d1 and d12" and insert -- d1 and d2 --.

Column 12,
Line 13, delete "dispose" and insert -- disposed --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*